US005839948A

United States Patent [19]

Kronberg

[11] Patent Number: 5,839,948

[45] Date of Patent: Nov. 24, 1998

[54] RIGHT ANGLE SANDERS FOR WET SANDING

[75] Inventor: John W. Kronberg, Chesire, Conn.

[73] Assignee: American Stonecrafters, Inc., Wallingford, Conn.

[21] Appl. No.: 697,588

[22] Filed: Aug. 27, 1996

[51] Int. Cl.[6] ..... B24B 23/02; B24B 55/02

[52] U.S. Cl. ..... 451/353; 451/359; 451/450

[58] Field of Search ..... 451/53, 344, 352, 451/353, 354, 358, 359, 450

[56] References Cited

U.S. PATENT DOCUMENTS

| | | | |
|---|---|---|---|
| 796,466 | 8/1905 | Stolzenberg | 451/450 |
| 1,452,926 | 4/1923 | Orlando | 451/353 |
| 1,600,054 | 9/1926 | MacLaughlin et al. | 451/450 |
| 1,698,970 | 1/1929 | Shaff | 451/450 X |
| 1,706,402 | 3/1929 | Hawn | 451/450 X |
| 1,971,790 | 8/1934 | Mall | 451/450 X |
| 2,106,035 | 1/1938 | Mall | 451/353 |
| 2,626,493 | 1/1953 | Speicher | 451/450 |
| 2,733,562 | 2/1956 | Drummond | 451/450 |
| 3,110,993 | 11/1963 | Grage | 451/450 |
| 3,345,281 | 10/1967 | Falls | 451/450 X |
| 3,934,377 | 1/1976 | Tertinek | 451/353 |
| 4,102,084 | 7/1978 | Bloomquist | 451/450 X |
| 5,088,241 | 2/1992 | Lubbering et al. | 451/53 X |

FOREIGN PATENT DOCUMENTS

| | | | |
|---|---|---|---|
| 533284 | 3/1958 | Italy | 451/353 |

*Primary Examiner*—Timothy V. Eley

[57] ABSTRACT

A right angle power sander for wet sanding is provided. The sander employs a tubular rotating shaft which has positioned axially therein a water supply tube for supplying water to a sanding disk secured to the rotating shaft. Water is forced through the annular space between the inside of the shaft and the outside of the tube toward the upper surface of the sander if a water blockage occurs. The annular space provides an open ended water supply system and increases the life and operating characteristics of the sander.

9 Claims, 3 Drawing Sheets

RIGHT ANGLE SANDERS FOR WET SANDING

BACKGROUND OF THE INVENTION

1. Field of the Invention

This invention relates to power machines which use water during operation of the machine, and in particular, to hand-held power machines for sanding and polishing substrates wherein water contacts a rotating, sanding and/or polishing disk to enhance the quality of the sanding and/or polishing effect on the substrate.

2. Description of Related Art

Power machines are well known and are used in a variety of industrial and household applications. Exemplary machines include saws, such as reciprocating saws, circular saws and jigsaws, drills and routers. Another important class of power machines are sanders and polishers of which there are belt, reciprocating and circular types. For convenience the following description will be directed to sanding although it will be understood to those skilled in the art that the invention also relates to polishing, buffing and other operations where a substrate is contacted with an abrasive to smooth or otherwise condition the substrate.

Circular sanders, particularly for household use, may be generally described as comprising a handheld housing with a protruding drive shaft which rotates when powered. An abrasive circular disk is attached to the shaft and rotates with the shaft and provides a sanding action to the substrate which comes in contact with the moving disk. A right angle sander is a particular type of sander which may be defined as comprising a handheld housing where the protruding drive shaft is at a right angle to the longitudinal axis of the housing and the following description will be mainly directed to this type sander.

Many types of sanding operations use water to contact the base of a rotating disk which contacts the substrate. Typically, water is flooded onto the rotating disk and/or substrate surface using a hose or other such water source and the flooded sander moved over the substrate to provide the desired wet sanding effect. Typically substrates include various types of stone, metal, plastic and other materials not damaged by water.

Unfortunately, the water used to flood the substrate surface and rotating disk adversely affects the life of the machine due to problems such as corrosion because of seepage of water through the machine seals into the machine housing. This seepage of water affects the seals, bearings, and power source and it has been found that these machines are only operable for a relatively short period of time after which they must be repaired or replaced which is a nuisance and costly.

To increase the effectiveness of the wet sander machines and to decrease the corrosion and other problems associated with the use of water during operation of the machine, it has been proposed to use a tubular drive shaft into which water is pumped under pressure through the opening in the shaft to the lower disk surface which water contacts the substrate being sanded. Basically, such machines use an elongated tubular shaft which extends through the housing from the upper surface of the housing to the lower surface of the housing and projects from the lower surface and to which projected portion the disk is secured. Typically, the water is pumped through the opening in the shaft and exits below the lower surface of the disk and provides the water necessary for the wet sanding operation. This design may be broadly classified as a closed design and if the bottom of the drive shaft becomes clogged or even partially clogged the water flow is restricted and water leaks into the housing. This leakage causes corrosion in the housing as noted above and is the primary cause of failure in these type of machines.

Bearing in mind the problems and deficiencies of the prior art, it is therefore an object of the present invention to provide an improved power sander and polisher particularly a right angle sander and/or polisher used for wet sanding and polishing having a longer machine operating life and enhanced sanding and polishing operation and effectiveness.

It is a further object of the present invention to provide a method for sanding and polishing a substrate using the improved power sander and polisher of the invention.

Another object of the invention is to provide sanded articles made using the sander and method of the invention.

Other objects and advantages of the invention will in part be obvious and will in part be apparent from the specification.

SUMMARY OF THE INVENTION

The above and other objects and advantages, which will be apparent to those skilled in the art, are achieved in the present invention in a first aspect which relates to an improved sander for wet sanding which comprises:

- a housing adapted preferably for holding by hand and preferably elongated, the housing having an upper surface and a bottom surface;
- an elongated tubular rotatable shaft having an upper end proximate or extending through the upper surface of the housing and a lower end extending through and projecting from the bottom surface of the housing to which at the lower end of the shaft a sanding disk is secured;
- means for rotating the shaft;
- a tube smaller in outside diameter than the inside diameter of the tubular shaft and extending axially through the shaft and having a water inlet end at the upper end of the shaft and tube and a water outlet end at the lower end of the tube, preferably proximate the base of the sanding disk, wherein the tube forms an annular opening between the inside of the shaft and the outside of the tube; and
- means for introducing water into the inlet end of the tube and wherein the water exits the outlet end of the tube.

In a second aspect of the invention, the improved sander of the invention has a bracket attached to or integral with the upper surface of the sander which bracket overlies the rotating shaft and axially positioned tube which bracket contains water conduit means for attaching to the tube and valve means to control the flow of water through the conduit means and into the tube. The bracket is also preferably designed so that when the sander is not in use the sander may be rested on the bracket for positioning the sander until needed. A preferred sander is termed a right angle sander as described further hereinbelow.

In a further aspect of the invention there is proposed a method for using the improved sander of the invention to provide enhanced polishing and sanding effects and polished and sanded articles and to improve the operating life of the sander.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(s)

Figure 1:
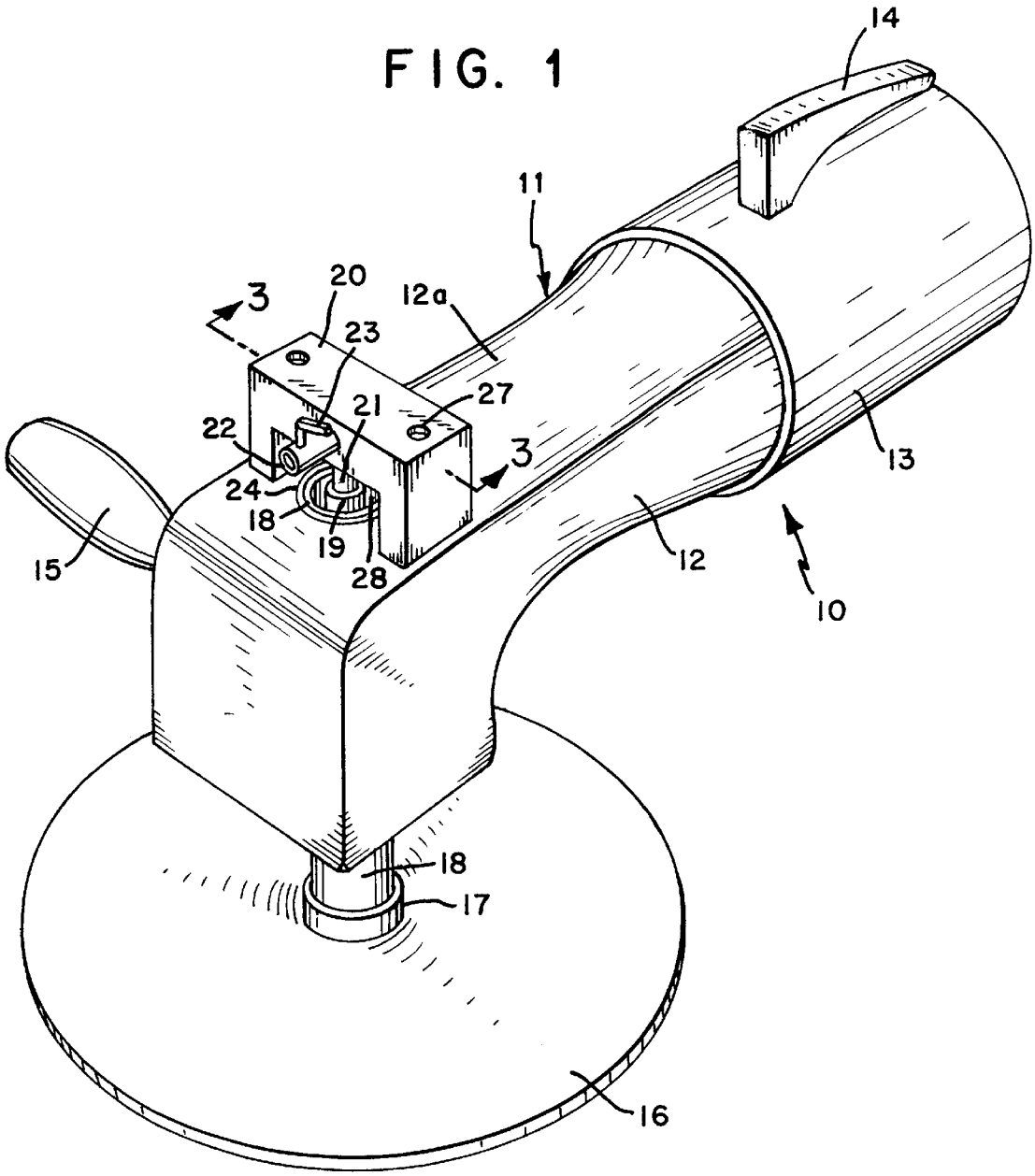
FIG. 1 is a perspective view of the improved wet sander of the invention.

In describing the preferred embodiment of the present invention, reference will be made herein to FIGS. 1–4 of the drawings in which like numerals refer to like features of the invention. Features of the invention are not necessarily shown to scale in the drawings.

With reference to FIG. 1, a sander of the invention is shown generally as 10. The sander 10 comprises a housing shown generally as 11 comprising an elongated housing body 12 having an upper surface 12*a* and an elongated housing handle 13. The housing may be metal or plastic as is conventional in the art. The housing handle 13 has a power actuator or switch 14 which is used to start and stop the power source such as a motor, compressed air, hydraulic fluid, etc. The sander 10 typically has a handle 15 so that the person using the sander will have one hand on handle 15 and the other hand on housing handle 13 and will be able to control movement of the machine over the substrate being sanded and also control starting and stopping the machine using the power actuator 14.

A sanding or polishing disk 16 is shown connected to the rotatable tubular shaft 18 of the sander by disk collar 17. The tubular shaft 18 must be structurally strong and is generally made of metal such as steel. Typically the disk collar 17 has internal threads and is threaded onto mating external threads on shaft 18. Locking devices (not shown) lock the disk 16 to the shaft 18. The sander shaft 18 is shown having extended axially therethrough a water tube 19 which tube is shown extending past the upper surface 12*a* of the housing body 12. The tube 19 is preferably rigid and may be metal, plastic, etc. and is smaller in diameter than the inside diameter of the shaft 18 and is connected to a water supply inlet conduit 21. The diameter of the tube is sized to have an outside diameter smaller than the inside diameter of the shaft 18 to provide an annular space therebetween sufficient to allow water to flow up the annular space toward the upper surface 12*a* of the housing body 12 in the event of a blockage or other malfunction. The inside diameter of the tube 18 is sized to permit the desired water flow to the disk 16. The water supply inlet conduit 21 is connected to conduit 22 to which a water supply such as a hose would be attached. Bracket 20, which is normally reversible, acts as an elbow and conduit connecting conduit 21 with conduit 22 and may be secured to housing 12 by bolts inserted through openings 27. A valve 23 is used to control the supply of water through conduits 22 and 21 to tube 19. Seal 24 may be any conventional seal such as a sealed bearing to allow rotation of shaft 18. Internal bearings and the power source are not shown for clarity. Radial spacers may be connected to the tube to maintain the tube centrally positioned in the shaft opening.

In operation, a water hose would be connected to conduit 22 and the water supply valve 23 opened pumping water into tube 19. The water would exit below the lower surface of disk 16 (not shown). The sander machine 10 would be activated by power actuator 14 and moved over the substrate surface to be sanded by the person operating the machine. Broadly stated, water will flow down and out the tube 19 and flood the disk and substrate surface providing a wet sanding operation. If there is a blockage due to grit, sand or other obstruction, or if there is an over pressurization, water will be diverted (bypassed) and flow upwards through the annular space between the tube and the shaft and rise up the annular space 28 toward the upper surface 12*a* of the housing body 12. If excessive stoppage is occurring, water will flow out from the annular space 28 onto the upper surface 12*a* of the housing. The operator of the machine upon seeing any such overflow can, for example, stop operation of the machine or shut the water supply valve 23 until the obstruction is removed and a normal wet sanding operation is resumed. The operator may also shut off the machine and water supply to check for the problem.

As noted above the prior art machine using a tubular rotating shaft is not effective because of clogging problems and resulting seepage into the machine can cause corrosion of the machine. That type machine using a tubular shaft only may be termed a closed system machine and is to be contrasted with the machine of the invention which may be termed an open system where any seepage problems caused by clogging or stoppage of the water is minimized or even eliminated by the water diversion and bypass system of the improved machine. It has been found that the improved machine has an operating life significantly greater than prior art sanders.

Figure 2:
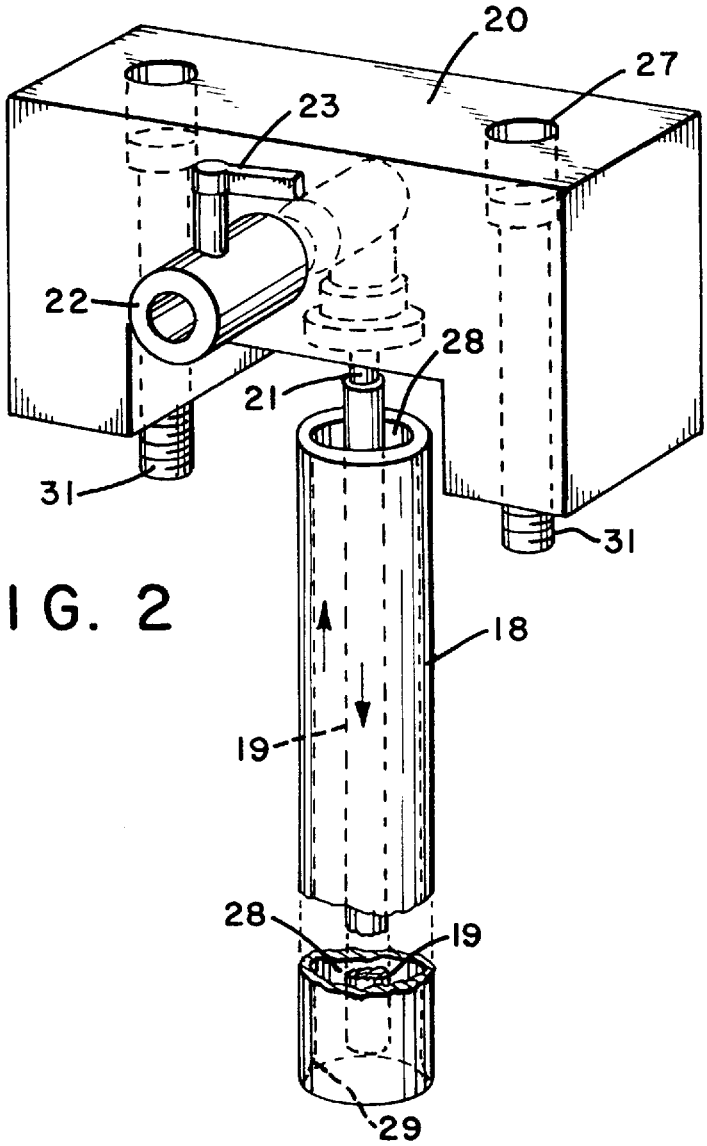
FIG. 2 is a perspective view of the bracket and tubular rotatable shaft and water supply tube used with the sander of the invention.

FIG. 2 shows a water supply bracket 20 used in conjunction with the wet sander of the invention and the bracket 20 has bolt openings 27 and bolts 31 therein for securing the bracket to the upper surface of the housing. Water supply valve 23 is shown connected to conduit 22 which conduit is connected to water supply tube 21. Tube 21 is shown fixedly connected to water tube 19. A threaded connection or force fit connection could be used. Tube 19 is axially positioned in tubular rotatable shaft 18 providing annular space 28. Water is shown flowing in the direction of the arrows and flows downward from conduits 22 and 21 through water tube 19 and would exit at the bottom of tube 19 into the opening at the bottom of shaft 18. Rotatable shaft 18 is shown having a tapered bottom 29 to assist in the distribution of the water flowing out of tube 19. If there are any obstructions on the substrate or in the shaft, water flow would be bypassed and flow upwards through the annular space 28 between shaft 18 and tube 19 and exit at the upper end of shaft 18.

Figure 3:
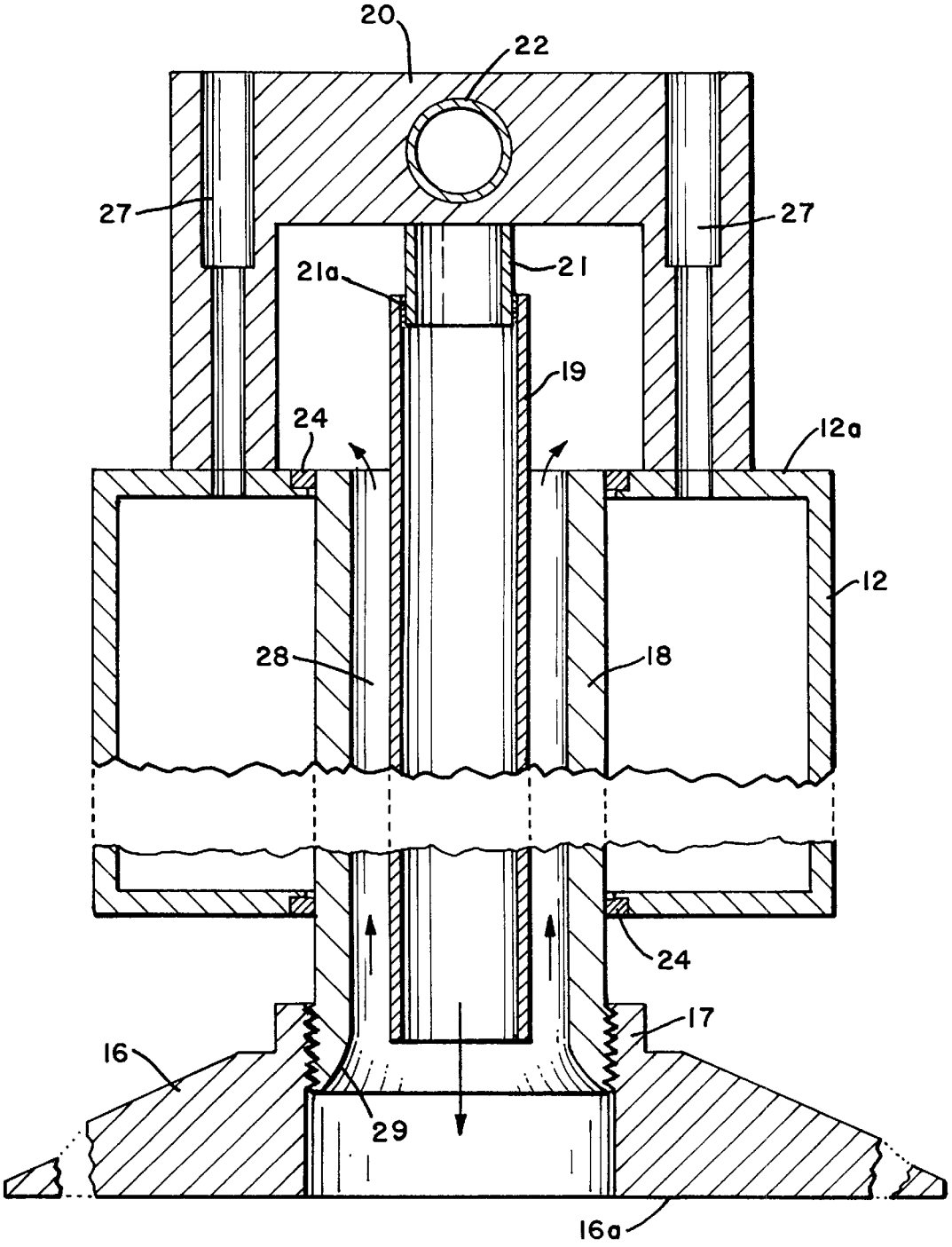
FIG. 3 is a cross-sectional view of FIG. 1 taken along lines 3—3.

With regard to FIG. 3, a cross-sectional view of the rotatable shaft 18 and water tube 19 structure of the improved wet sander of the invention is shown. The water supply bracket 20 is shown having water supply conduit 22 connected to water supply inlet 21. Water supply inlet 21 is shown having barbs 21*a* on the exterior surface thereof to secure water tube 19 to water inlet 21 by a force fit. The tube 19 extends axially through tubular shaft 18 and is shown extending almost to the bottom of the shaft 18. It is preferred that the tube extend near the bottom of the shaft for enhanced operating effects although it may extend only partially through the shaft or even, for some applications, below the bottom of the shaft. The shaft 18 is shown extending up to the upper surface 12*a* of housing body 12 and seals and sealed bearings 24 are shown between the housing structure 12 and shaft 18. Sanding disk 16 is shown secured to shaft 18 by screw collar 17.

As can be seen in FIG. 3, the water flows out of the end of tube 19 to the bottom surface 16*a* of disk 16 and provides the liquid necessary for the wet sanding operation. In the event of an obstruction, water would flow upward through the annular space 28 between rotatable shaft 18 and tube 19 toward the upper surface 12*a* of housing 12. The water is also shown exiting at the top surface 12*a* of housing 12. If water exits at this point the operator knows a problem exists and the water supply can be turned off, the machine turned off, or other action taken to correct the problem.

Figure 4:
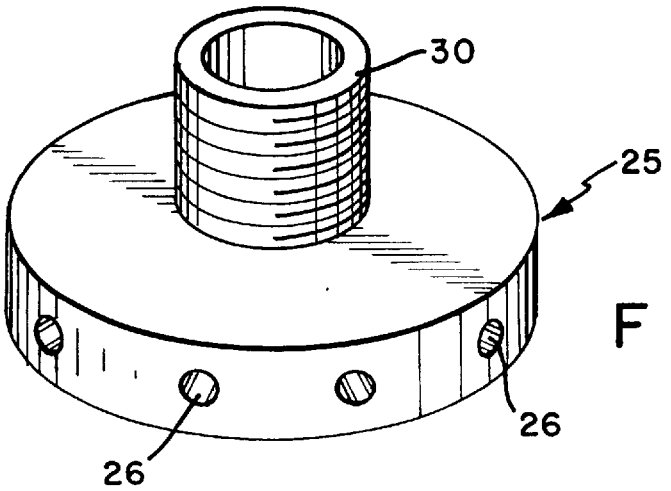
FIG. 4 is a perspective view of a water distribution device which may be used in conjunction with the invention to distribute the water exiting from the tube to a sander disk attached to the rotating shaft of the sander.

FIG. 4 shows a preferred embodiment for use with the sander of the invention. Thus, a water distribution device is shown as 25 having a tubular collar 30. The collar 30 would be sized to force fit or be threaded into shaft 18 and water in tube 19 would enter the opening at the upper end of collar 30 and exit the water distributor 25 through openings 26 shown spaced around the periphery of the distributor. The openings 26 typically are conduits extending from the periphery of device 25 through the device to the collar opening. This type design enhances the distribution of the water to the sander disk and increases the effectiveness of the water sander operation.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A power sander useful for wet sanding and polishing comprising:

a housing having an upper surface and a bottom surface;

a tubular rotatable shaft having an inside diameter and an upper end extending through the upper surface of the housing and a lower end extending through and projecting from the bottom surface of the housing to which a sanding disk is secured thereto, the disk having an opening therein to allow water to flow therethrough;

means for rotating the shaft; and a tube having an upper end and a bottom end, which tube is smaller in outside diameter than the inside diameter of the tubular shaft and extending axially through the upper surface of the housing and the shaft and having a water inlet end at the upper end of the tube and a water outlet end at the bottom end of the tube wherein the tube forms an annular opening between the inside of the shaft and the outside of the tube which annular opening extends to the upper surface of the housing; and means for introducing water into the upper end of the tube and wherein the water exits the bottom end of the tube and floods the disk and if there is a blockage or over pressurization, the water is diverted and flows upward through the annular opening toward the upper surface of the housing and, if excessive, water will flow out from the annular opening onto the upper surface of the housing.

2. The power sander of claim 1 wherein the tube extends through the shaft to a point proximate the bottom of the shaft.

3. The power sander of claim 2 wherein a bracket containing water supply means is secured to the upper surface of the housing and the water supply means is connected to the tube.

4. The power sander of claim 3 wherein the water supply means has a valve for controlling the flow of water to the tube.

5. The power sander of claim 2 wherein the disk is a polishing disk.

6. The power sander of claim 1 having a handle extending from the housing and a switch for controlling the power to the sander.

7. The power sander of claim 6 which is a right angle sander.

8. A sanded article made using the sander of claim 7.

9. A sanded article made using the sander of claim 1.

* * * * *